US009365990B2

(12) United States Patent
Onda

(10) Patent No.: US 9,365,990 B2
(45) Date of Patent: Jun. 14, 2016

(54) FLOATING-TYPE SANDY BEACH GROWING DEVICE

(71) Applicant: Ginjirou Onda, Tokyo (JP)

(72) Inventor: Ginjirou Onda, Tokyo (JP)

( * ) Notice: Subject to any disclaimer, the term of this patent is extended or adjusted under 35 U.S.C. 154(b) by 0 days.

(21) Appl. No.: 14/458,716

(22) Filed: Aug. 13, 2014

(65) Prior Publication Data

US 2016/0047100 A1 Feb. 18, 2016

(51) Int. Cl.
*E02B 3/04* (2006.01)

(52) U.S. Cl.
CPC .. *E02B 3/04* (2013.01); *E02B 3/043* (2013.01)

(58) Field of Classification Search
USPC ..... 405/21, 24, 26, 28, 63
See application file for complete search history.

(56) References Cited

U.S. PATENT DOCUMENTS 2,055,150 A * 9/1936 Heskett ..... E02B 3/04 405/32
6,860,219 B1 * 3/2005 Dempster ..... B63B 1/22 114/264

FOREIGN PATENT DOCUMENTS

JP H06212611 A 8/1994
JP H10237842 A 9/1998
JP 3609052 B2 1/2005
JP 2014-058812 A 4/2014

* cited by examiner

*Primary Examiner* — Sean Andrish
(74) *Attorney, Agent, or Firm* — Browdy and Neimark, PLLC

(57) ABSTRACT

A floating-type sandy beach growing device includes wave absorbing bodies arranged in parallel at appropriate intervals, each of them including a floating body having an offing side end oriented toward offing side and a land side end having a larger buoyancy and oriented toward land side, rocking following a wave vertical movement, offing side end being pivotally supported, and a stand erected in a relatively shallow shore for pivotally supporting offing side end, floating body being level-adjusted so as to be horizontal during low tide in neap tide, and installed angled with respect to wave progress direction in a horizontal plane.

3 Claims, 5 Drawing Sheets

FLOATING-TYPE SANDY BEACH GROWING DEVICE

BACKGROUND OF THE INVENTION

1. Technical Field

The present invention relates to a floating-type sandy beach growing device, and more particularly, to a floating-type sandy beach growing device installed in water in sea or river to exert the wave absorbing capability, thereby preventing possible damages due to tsunami, high waves, and the like, and being contributable to growing of a sandy beach.

2. Description of the Related Art

In order to prevent possible damages resulting from tsunami, high waves, and the like, a variety of wave absorbing devices to be installed in a relatively shallow shore have been disclosed. Examples include a breakwater wherein a plurality of V-shaped bent bank bodies are provided in parallel with one another, being exposed from the water surface, and between adjacent bank bodies, a V-shaped bent water channel is provided (Japanese Unexamined Patent Application Publication No. Hei 6-212611), and a wave absorbing structure comprising one or more wave absorbing units which are each formed in the shape of an arc (substantially in the shape of a hemisphere) against a wave in any coming direction, and provided with a hollow chamber in the inside thereof, the hollow chamber being communicated with the seawater through an opening provided in the portion to be opposed to a wave in a typical coming direction (Japanese Unexamined Patent Application Publication No. Hei 10-237842).

These conventional wave absorbing devices are expensive in and of themselves due to their structures; are time-consuming for installation; and involve an increased total cost. To eliminate such drawbacks, the present inventor has already disclosed a wave absorbing method and a wave absorbing device, having a simple structure, being relatively low in cost of the device itself and installation cost, and yet providing an effective wave absorbing effect (Japanese Patent Publication No. 3609052).

The wave absorbing device in accordance with the invention as disclosed in Japanese Patent Publication No. 3609052 is a wave absorbing device comprising one or more wave absorbing bodies having an open side extending in the longitudinal direction and a C-shaped cross section, to be installed in water in a relatively shallow shore with the open side being oriented against the wave progress direction and angled with respect to the wave progress direction, and thereby, upon the wave hitting the offing side end of the wave absorbing body, allowing a flow to be created in the wave absorbing body by a water flow pressure difference caused between the inside of the offing side end of the wave absorbing body and the inside of the land side end thereof.

However, even in the case of this wave absorbing device, the cost of the wave absorbing body itself including the fixing piles and the cost of installation working therefor are high, and thus, the advent of a wave absorbing device the cost of which is suppressed to a less one has been earnestly demanded. In addition, with the aforementioned wave absorbing device, at the time of installation thereof, a great gap is produced between wave absorbing bodies, and there is the possibility that a wave may pass through the gap to make the wave absorption action of the device insufficient.

Patent document 1: Japanese Unexamined Patent Application Publication No. Hei 6-212611

Patent document 2: Japanese Unexamined Patent Application Publication No. Hei 10-237842

Patent document 3: Japanese Patent Publication No. 3609052

The present invention has been made in view of the problems with the aforementioned conventional wave absorbing device, and it is an object of the present invention to provide a floating-type sandy beach growing device which is free from the problem that a part of a wave may pass through the gap between wave absorbing bodies to impede the wave absorption action of the device; which can be constructed relatively easily and at a low cost; and which exerts a wave-absorbing action positively and effectively, resulting in a sandy beach being grown.

SUMMARY OF THE INVENTION

A floating-type sandy beach growing device can be constructed relatively easily and at low cost, and can reliably and effectively exert a wave absorbing action, thereby effectively preventing possible damages due to tsunami, high waves, etc., and being capable of simultaneously contributing to sandy beach growth. The floating-type sandy beach growing device is constituted by wave absorbing bodies arranged in parallel at appropriate intervals, each of them including a floating body having an offing side end oriented toward offing side and a land side end having a larger buoyancy and oriented toward land side, rocking following a wave vertical movement, offing side end being pivotally supported, and a stand erected in a relatively shallow shore for pivotally supporting offing side end, floating body being level-adjusted so as to be horizontal during low tide in neap tide, and installed angled with respect to wave progress direction in a horizontal plane.

The present invention for solving the aforementioned problems provides a floating-type sandy beach growing device constituted by a plurality of wave absorbing bodies arranged in parallel with one another at appropriate intervals, each of the wave absorbing bodies including a floating body having an offing side end oriented toward the offing side and a land side end having a buoyancy larger than that of the offing side end and oriented toward the land side, rocking following a vertical movement of a wave, the offing side end being pivotally supported, and a stand being erected in water in a relatively shallow shore for pivotally supporting the offing side end, the floating body being adjusted for level so as to be horizontal during low tide in the neap tide, and installed so as to be angled with respect to the wave progress direction in a horizontal plane.

In one embodiment, the floating body is formed by bundling a number of bamboos, or the like, the root side thereof providing the offing side end, being bound and pivotally supported, while the leaf side providing the land side end without being bound. In another embodiment, the floating body is a hollow cylindrical body made of resin with which the land side end is thickened, compared to the offing side end.

In another embodiment, a receiving stand is further included which is installed under the land side end of the floating body, thus receiving the land side portion of the floating body to prevent it from being buried in the sea bed. In addition, the stand may be provided with a stopper for regulating the erection angle of the floating body.

As described above, the floating-type sandy beach growing device in accordance with the present invention is a floating-type sandy beach growing device constituted by a plurality of wave absorbing bodies arranged in parallel with one another at appropriate intervals, each of the wave absorbing bodies including a floating body having an offing side end and a land side end having a buoyancy larger than that of the offing side end, rocking following a vertical movement of a wave, the offing side end being pivotally supported, and a stand pivotally supporting the offing side end, the floating body being adjusted for level so as to be horizontal during low tide in the neap tide, and installed so as to be angled with respect to the wave progress direction in a horizontal plane, with it providing advantages of having a simple configuration; being capable of being constructed relatively easily and at a low cost; the floating body of the respective wave absorbing bodies being rocked following a wave, thereby a wave absorbing effect being provided; and thus the sea bed being prevented from being scooped, with a sandy beach being grown.

According to one embodiment of the present invention, there is provided an advantage that the material cost can be significantly cut. According to one embodiment of the invention, there is provided an advantage that excessive downward rocking is suppressed, thereby adherence of seaweeds, and the like, thereto being prevented to the utmost, and thus the buoyancy of the floating body being maintained. According to one embodiment of the invention, there is provided an advantage that reversal of the floating body is suppressed, thereby damage to the wave absorbing body being prevented.

DETAILED DESCRIPTION OF THE PREFERRED EMBODIMENTS

Figure 1A:
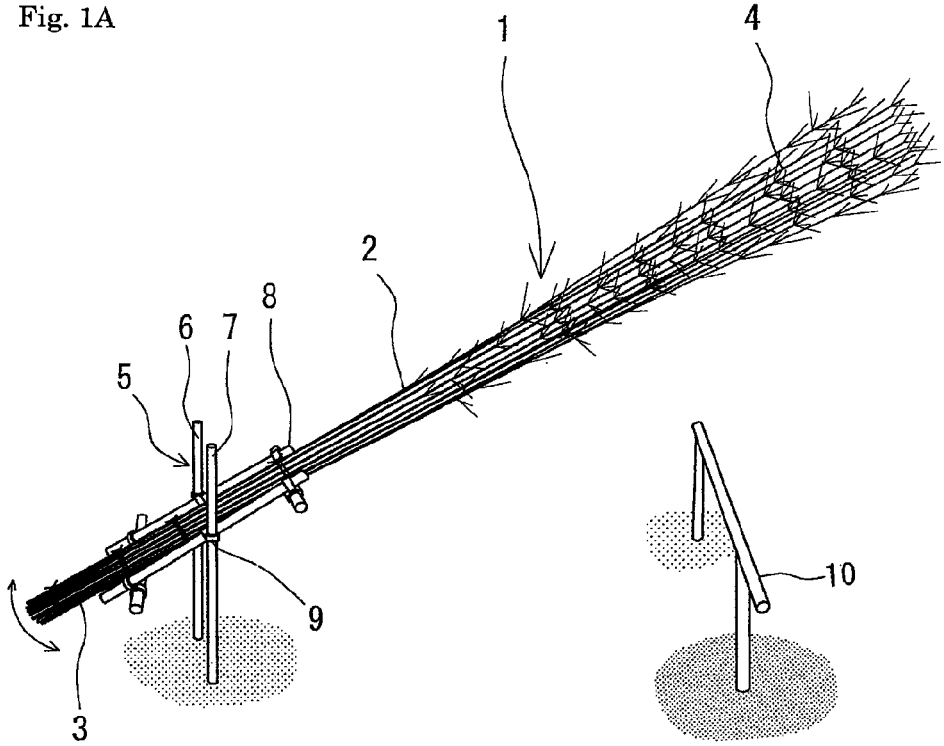
FIG. 1A is a perspective view showing a wave absorbing body in an inclined position in one embodiment of a floating-type sandy beach growing device in accordance with the present invention.

An embodiment of the present invention will be explained with reference to the accompanying drawings.

As shown in FIG. 1A to FIG. 3, a floating-type sandy beach growing device in accordance with the present invention is constituted by a plurality of wave absorbing bodies 1 arranged in parallel with one another, each of the wave absorbing bodies 1 including a floating body 2 having an offing side end 3 oriented toward the offing side at the time of installation and a land side end 4 oriented toward the land side at the time of installation, and rocking in response to a wave, and a stand 5 erected in, for example, relatively shallow water 100 to 200 m offshore, and pivotally supporting the offing side end 3. A plurality of such floating-type sandy beach growing devices are arranged at appropriate intervals such that the wave absorbing body 1 is angled with respect to the wave progress direction in a horizontal plane (see FIG. 1A).

Figure 2:
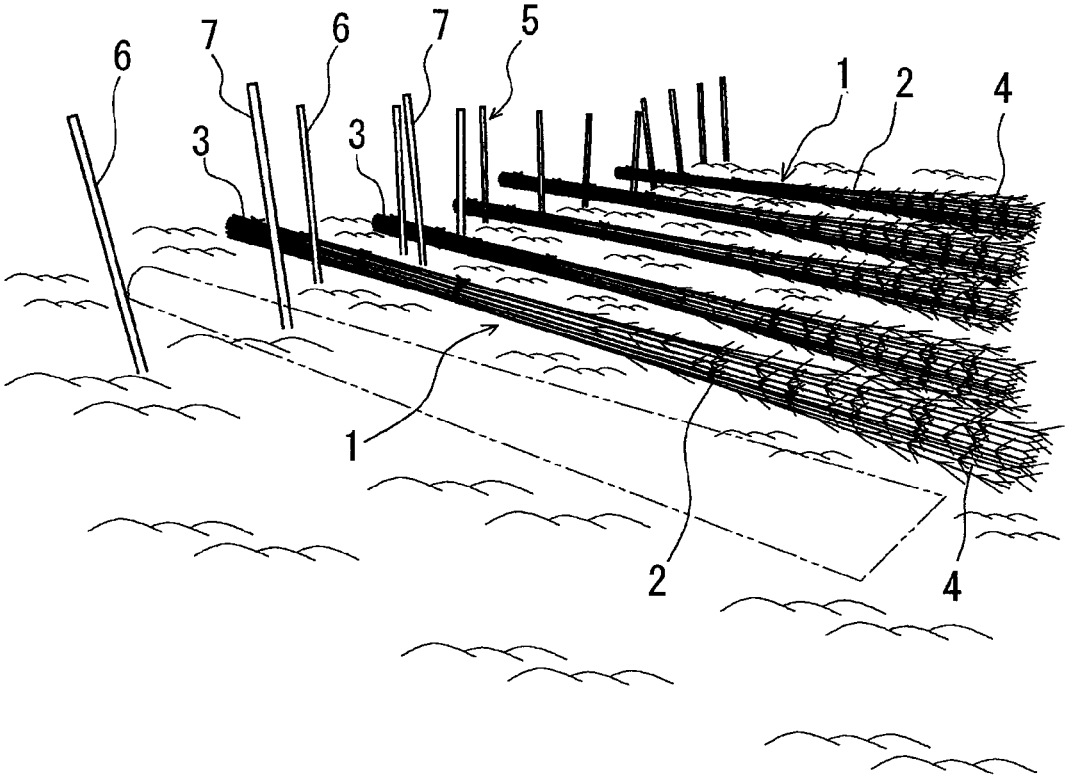
FIG. 2 is a perspective view showing an installation condition of the floating-type sandy beach growing device in the one embodiment of the floating-type sandy beach growing device in accordance with the present invention.
Figure 3:
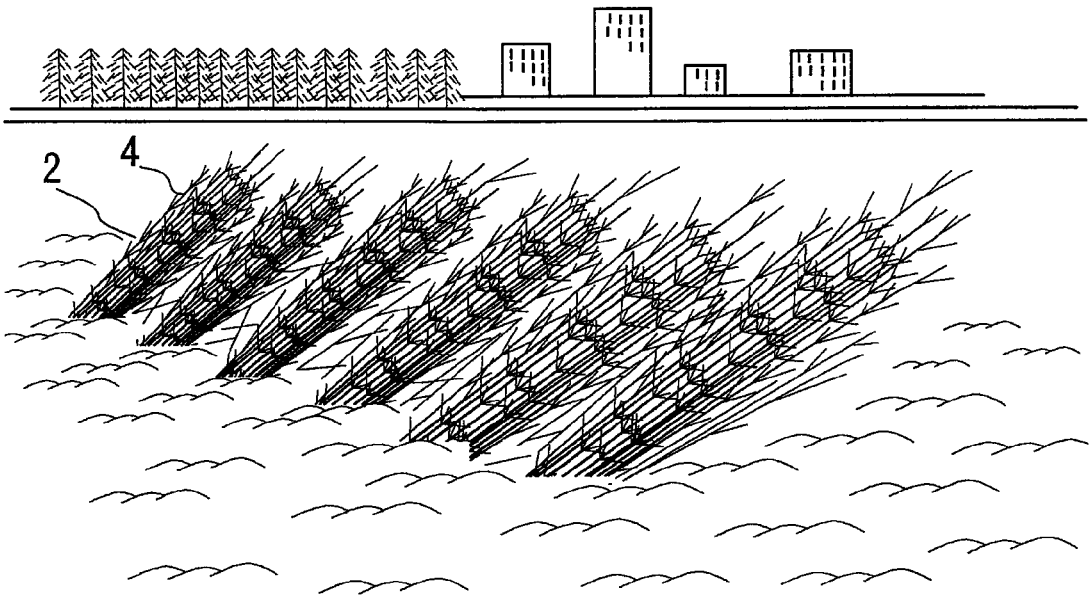
FIG. 3 is a perspective view showing a rocking state of the floating-type sandy beach growing device in the one embodiment of the floating-type sandy beach growing device in accordance with the present invention.

The floating body 2 is formed so as to have a sufficient buoyancy on the land side. The floating body 2 in the embodiment shown in FIG. 1 to FIG. 3 is formed by bundling a number of (for example, 30 to 40) bamboos, or the like, 4 to 5 meters long. In this case, the root side provides the offing side end 3 which is oriented toward the offing side at the time of installation, while the leaf side providing the land side end 4 which is oriented toward the land side at the time of installation, with the offing side end 3 being bound in, for example, three or four places, and the land side end 4 being not bound to be appropriately loosened and spread. Each floating body 2 is rocked following the vertical movement of a wave, the offing side end 3 being pivotally supported by the stand 5, and depending upon the water level, may be brought into an erected state (as shown in FIG. 3).

The stand 5 is formed by, for example, assembling of metal pipes, being comprised of a pair of support poles 6, 7 which are to be erected in water, a fixing frame 8 which is formed by assembling metal pipes lengthwise and breadthwise for fixing the offing side end 3 of the floating body 2, and a universal joint 9 which is disposed between the fixing frame 8 and the support pole 6, 7 for rockably journaling the fixing frame 8. In this case, the offing side end 3 of the floating body 2 is fixed to the fixing frame 8 by placing it on the fixing frame 8 and fastening it thereto, or by taking other means. The length of a portion of the offing side end 3 to which the fixing frame 8 is fixed is specified to be one fourth of the overall length of the floating body 2.

Figure 1B:
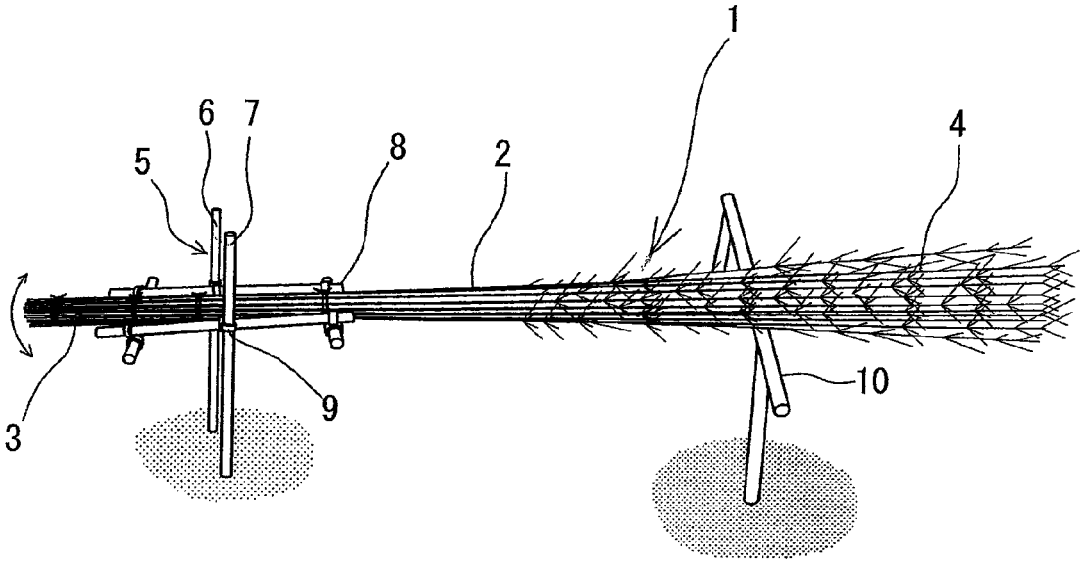
FIG. 1B is a perspective view showing a wave absorbing body in a horizontal orientation in one embodiment of a floating-type sandy beach growing device in accordance with the present invention.

The pivotally supported position level of the floating body 2 in the stand 5 is set such that the respective floating bodies 2 are in the horizontal state during low tide in the neap tide (see FIG. 1B for the horizontal orientation of the floating body 2). This level corresponds to the level at which the drift sand from the offing passes, and the sea level at the time of the off-shore current passing, and by setting the pivotally supported position level of the floating body 2 to be as such, it is prevented that the respective floating-type sandy beach growing devices are exposed to above the water, thereby the scenery of the sea being impaired.

In a preferred embodiment, the stand 5 is provided with a stopper (not shown) which regulates the erection angle of the floating body 2 to thereby prevent reversal thereof. This stopper can be formed of, for example, a pipe spanned across the support poles 6, 7 at a level higher than the fixing frame 8. Needless to say, in that case, the pipe is spanned across the support poles 6, 7 on the land side thereof. Alternatively, the stopper may be pins which protrude from the support poles 6, 7 to above the upper side of the fixing frame 8.

In addition, in a preferred embodiment, under the land side end 4 of the floating body 2, there is installed a receiving stand 10 for receiving the land side portion of the floating body 2 to prevent it from being buried in the sea bed. The receiving stand 10 may be provided for each floating body 2, or may have a length which covers a plurality of floating bodies 2 to allow the plurality of floating bodies 2 to be received by the receiving stand 10. The level of the receiving stand 10 is set to be approximately the same as the pivotally supported position level of the offing side end 3 of the floating body 2, thereby the floating body 2 being held at a level equal to or higher than the water level during low tide in the spring tide.

In this embodiment, with the floating body 2 being received by the receiving stand 10, a space for tolerating passage of an off-shore current between the floating body 2 and the sea bed is always secured, thereby the drift sand being carried toward the land side, while the off-shore current flowing toward the offing without being blocked in any way by the floating body 2. Further explaining this point, the wave which has come to the shallows through a sea bed slope will return toward the offing side as an off-shore current, while the wave on the land side of the respective floating-type sandy beach growing devices has lost power, and thus upon being returned as an off-shore current, it will pass quietly through the space secured under the respective wave absorbing bodies 1. On the other hand, if such a space is not secured, the off-shore current will be dammed under the respective wave absorbing bodies 1, thereby a swirl flow being generated in the vicinity thereof, which causes the sand at the sea bed to be eroded, making it difficult to grow a sandy beach.

Further, the floating body 2 is prevented from being buried in the sea bed, being received by the receiving stand 10, and thus, it is reliably prevented that the floating body 2 is entangled with seaweeds, shellfishes, articles washed ashore, and the like, being buried in the sea bed, and due to the weights thereof, becomes impossible to float up, resulting in the wave absorbing effect being decreased. In addition, the receiving stand 10 is installed at a level which causes the floating body 2 to be held at a level equal to or higher than the water level during low tide in the spring tide, and thus the land side end 4 of the floating body 2 is exposed to the surface of the sea even during low tide in the spring tide. Therefore, the seaweeds, and the like, being entangled with the land side end 4 (the quantity thereof being not so large as compared to that of seaweeds, and the like, with which the floating body 2 would be entangled, if buried in the sea bed, however, a considerable quantity of floating seaweeds, and the like, being entangled therewith), are dried and blown off by the wind, thereby the buoyancy of the floating body 2 being secured.

Figure 4:
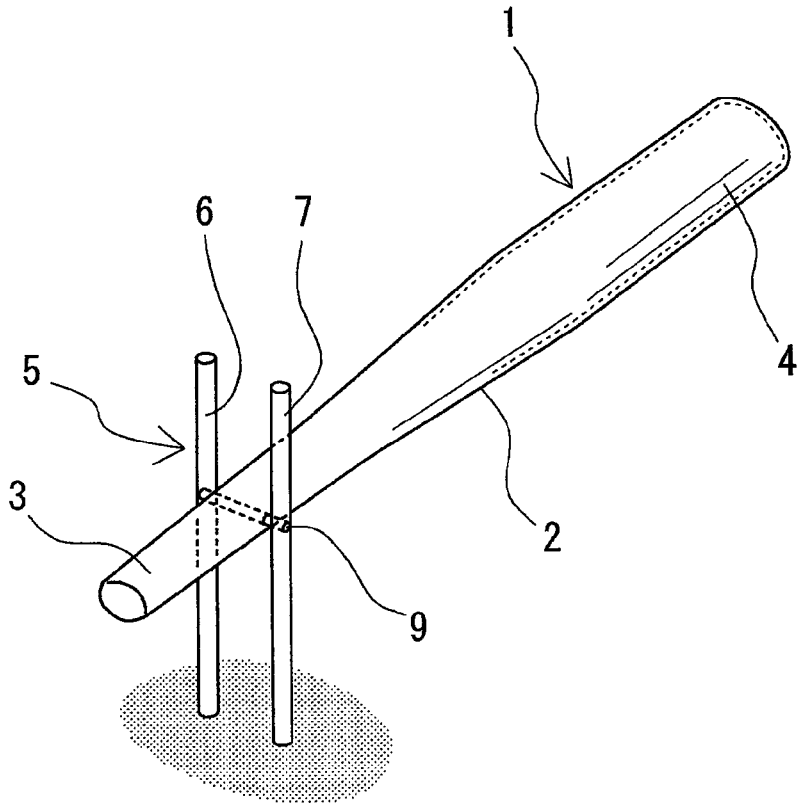
FIG. 4 is a perspective view showing a wave absorbing body in another embodiment of the floating-type sandy beach growing device in accordance with the present invention.

In an embodiment shown in FIG. 4, the floating body 2 is constituted by a hollow cylindrical body made of resin with which the land side end 4 is thickened compared to the offing side end 3. The floating body 2 in this case is made rockable with a shaft inserted into the offing side end 3 being journaled by the universal joint 9 installed in the support poles 6, 7.

Figure 5:
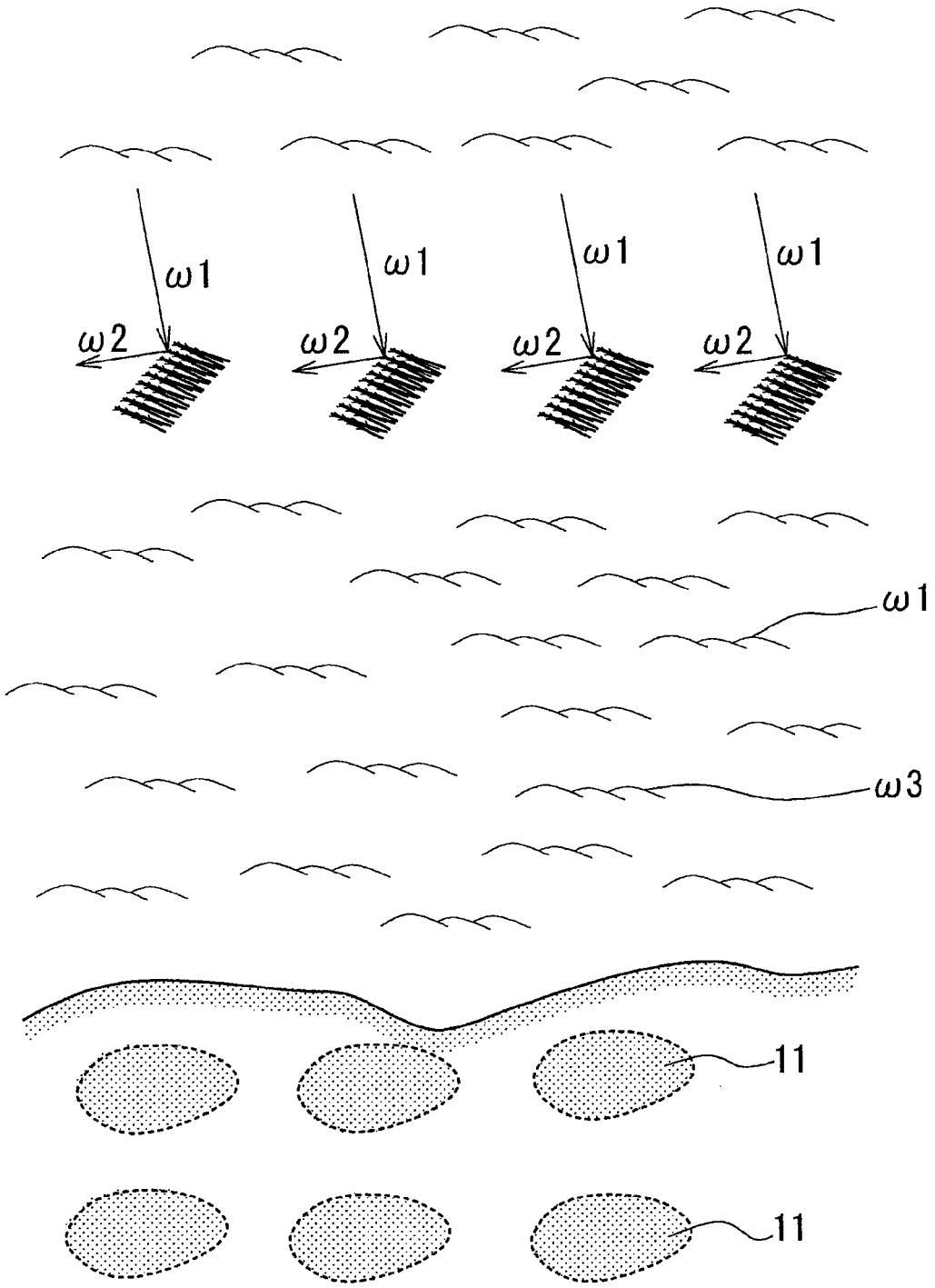
FIG. 5 is a figure for explaining the function of the floating-type sandy beach growing device in the one embodiment in accordance with the present invention.

The floating-type sandy beach growing device in accordance with the present invention is constituted by a number of wave absorbing bodies 1 each comprised of the floating body 2 and the stand 5 having the aforementioned configuration, respectively, the number of wave absorbing bodies 1 being arranged at such intervals as those which allow the spread land side ends 4 of adjacent floating bodies 2 to lightly contact with one another, or at intervals which are slightly wider than such intervals, and a plurality of such floating-type sandy beach growing devices are disposed, being angled at, for example, 20 to 45 degrees or so with respect to the wave progress direction in a horizontal plane (as shown in FIG. 5). A suitable installation location therefor is a place in water that is located 100 to 200 m offshore of the beach, and between deep and shallow areas, where white waves appear. The wave progress direction is determined by such factors as the geographical feature of the see bed on a particular shore.

The installation level thereof is set such that the pivotally supported position level of the respective floating bodies 2, in other words, the level of the universal joint 9 installed in the support poles 6, 7 is matched to the level of the sea surface during low tide in the neap tide in the installation location. The level adjustment of this universal joint 9 can be achieved by configuring the universal joint 9 such that it can be vertically moved with respect to the support pole 6, 7, or by changing the buried depth of the support poles 6, 7.

By installing the floating-type sandy beach growing device in accordance with the present invention as described above, not only the wave absorbing effect, but also the sandy beach growing effect can be provided. In other words, an incoming wave w1 which rushes toward the respective floating-type sandy beach growing devices hits the floating-type sandy beach growing device, a part thereof passing through the device to be dispersed and absorbed, while a part thereof being refracted approx. 90 degrees to become a reflected wave w2 (as shown in FIG. 5).

However, since the respective floating-type sandy beach growing devices are installed so as to be angled at, for example, 20 to 45 degrees or so with respect to the wave progress direction in a horizontal plane, the incoming wave w1 will not hit one floating-type sandy beach growing device over the entire width thereof at the same time, thereby a difference in time being generated between the time (the earliest time) when it hits the wave absorbing body 1 located the nearest to the offing side and the time (the latest time) when it hits the wave absorbing body 1 located the nearest to the land side. In other words, the refracting portion where the incoming wave w1 is changed into the reflected wave w2 is gradually moved along the device which is angled with respect to the wave progress direction, and during that process, a wave absorption action occurs.

As described above, the incoming wave w1 hits the respective floating-type sandy beach growing devices, and a part thereof passes from the gap between wave absorbing bodies 1, where the water stream pressure is lower, to the land side, thereby the incoming wave w1 being dispersed and absorbed. In addition, in accompaniment of such dispersion and absorption of the incoming wave w1, there is produced a drift sand stagnation area on the land side of the floating-type sandy beach growing device, the drift sand being accumulated therein, thereby a sandy beach being gradually grown. If the water level is raised, the respective floating bodies 2 are erected following the rise, and therefore the wave absorption action will not be lost at any water level.

The sea water which has hit a sloping face which extends from the deep area to the shallow one at the sea bed is changed into an ascending wave which will rise obliquely upward along the sloping face. In the case where such ascending wave hits the floating body 2 from thereunder, the floating body 2, the offing side end 4 of which is pivotally supported, will be rocked upward, being subjected to the ascending wave, while providing a resistance to absorb the wave. In addition, also in the case where such ascending wave rises on the offing side of the present device, and is broken to fall onto the floating body 2, the wave power will be damped by a resistance of the floating body 2. The incoming wave w1 rushing toward the land side will become weak also under the influence of such ascending wave.

The present inventor manufactured floating-type sandy beach growing devices having floating bodies 2 formed by bundling bamboos, and installed them as described above. Then, by observing the sandy beach four days after an atmospheric depression having passed, the present inventor could confirmed that, as shown in FIG. 5, two rows of small sand mounds 11 were formed on the offing side and the land side in places of the sandy beach. The two rows of small sand mounds 11 resulted from the drift sand having been piled up in two rows in accordance with a difference in high tide level between the nighttime and the daytime (the low tide and the high tide occurring two times a day, respectively), and the low area between adjacent sand mounds 11 indicates a trace of the passage of an off-shore current. Further, it could be confirmed that the sand forming such sand mounds 11 is blown off toward the land side by a sea breeze after being dried, resulting in a flat sandy beach being grown.

Hereinabove, the present invention has been explained in detail to some extent, and about the most preferred embodiment, however, it is obvious that a wide range of different embodiments can be made without departing from the spirit and scope of the present invention. For example, as the floating body, besides the configuration described above, there can be provided such a configuration as that in which branched projections or a number of lateral members are disposed in the end portion of a bar material. Therefore, it is to be understood that the present invention is not limited to the specific embodiments thereof except as defined in the appended claims.

What is claimed is:

1. A floating-type sandy beach growing device constituted by a plurality of wave absorbing bodies arranged in parallel with one another at appropriate intervals, each of said wave absorbing bodies comprising a floating body having an offing side end oriented toward an offing side and a land side end having a buoyancy larger than that of said offing side end and oriented toward a land side, said offing side end being pivotally supported to provide rocking following a vertical movement of a wave, a floating body stand erected in water and pivotably connected to said offing side end of said floating body to pivotally support said offing side end, and a receiving stand comprising a horizontal member and supporting members extending downward from said horizontal member to reach a sea bed, said receiving stand being installed under said land side end of said floating body at a predetermined distance from said floating body stand, to receive said land side end of said floating body on said horizontal member when said land side end rotates toward a sea bed to prevent said land side end from being buried in the sea bed, and wherein said floating body is adjusted to be oriented in a horizontal direction during low tide in a neap tide, and installed so as to be angled with respect to a wave progress direction in a horizontal plane.

2. The floating-type sandy beach growing device according to claim 1, wherein said floating body is formed by bundling a plurality of bamboos, a root side thereof providing said offing side end, being bound and pivotally supported on said floating body stand, while the leaf side providing said land side end without being bound.

3. The floating-type sandy beach growing device according to claim 1, wherein said floating body stand is provided with a stopper for regulating an erection angle of said floating body.

* * * * *